US011207790B2

(12) United States Patent
Buerk

(10) Patent No.: US 11,207,790 B2
(45) Date of Patent: Dec. 28, 2021

(54) OUT-THE-FRONT KNIFE WITH SIDE LOCKING MECHANISM

(71) Applicant: Andrew Buerk, Smethport, PA (US)

(72) Inventor: Andrew Buerk, Smethport, PA (US)

( * ) Notice: Subject to any disclaimer, the term of this patent is extended or adjusted under 35 U.S.C. 154(b) by 3 days.

(21) Appl. No.: 16/767,295

(22) PCT Filed: Nov. 27, 2018

(86) PCT No.: PCT/US2018/062527

§ 371 (c)(1),
(2) Date: May 27, 2020

(87) PCT Pub. No.: WO2019/104295

PCT Pub. Date: May 31, 2019

(65) Prior Publication Data

US 2021/0023725 A1 Jan. 28, 2021

Related U.S. Application Data

(60) Provisional application No. 62/591,081, filed on Nov. 27, 2017.

(51) Int. Cl.
*B26B 1/08* (2006.01)
*B26B 1/10* (2006.01)

(52) U.S. Cl.
CPC . *B26B 1/08* (2013.01); *B26B 1/10* (2013.01)

(58) Field of Classification Search
None
See application file for complete search history.

(56) References Cited

U.S. PATENT DOCUMENTS

| | | | | |
|---|---|---|---|---|
| 7,305,769 | B2 * | 12/2007 | McHenry | B26B 1/08 30/162 |
| 7,797,838 | B2 * | 9/2010 | Chu | B26B 1/08 30/162 |
| 8,499,460 | B1 * | 8/2013 | Pearman | B26B 1/044 30/155 |
| 8,966,771 | B2 * | 3/2015 | Chu | B26B 1/08 30/162 |
| 9,056,398 | B2 * | 6/2015 | Liao | B26B 1/08 |
| 9,375,854 | B2 * | 6/2016 | Chu | B26B 1/08 |
| 10,220,527 | B1 * | 3/2019 | Marfione | B26B 9/02 |
| 10,807,253 | B1 * | 10/2020 | Mandeville | B26B 1/08 |
| 10,981,284 | B2 * | 4/2021 | Delplanche | B26B 1/08 |

(Continued)

FOREIGN PATENT DOCUMENTS

WO WO 2019/217569 * 11/2019

*Primary Examiner* — Hwei-Siu C Payer
(74) *Attorney, Agent, or Firm* — Jonathan M. D'Silva; MMI Intellectual Property

(57) ABSTRACT

An out-the-front knife comprises a handle having a blade channel, a slider channel, and an insert channel interposed between them. A blade in the blade channel and a firing mechanism in the slider channel configured to extend and retract the blade. The blade comprising a blade insert configured to contact the firing mechanism. The firing mechanism comprises a front slider arm, a rear slider arm, a front lock, and a rear lock. When the blade is in the open position, the blade insert is biased against the front slider arm and the front lock and when the blade is in the closed position, the blade insert is biased against the rear slider arm and the rear lock.

21 Claims, 3 Drawing Sheets

(56) References Cited

U.S. PATENT DOCUMENTS

| | | | | |
|---|---|---|---|---|
| 2015/0367520 | A1* | 12/2015 | MacNair | B26B 1/044<br>30/161 |
| 2017/0050325 | A1* | 2/2017 | Lee | B26B 1/08 |
| 2021/0023725 | A1* | 1/2021 | Buerk | B26B 5/00 |
| 2021/0268671 | A1* | 9/2021 | Buerk | B26B 1/08 |

* cited by examiner

OUT-THE-FRONT KNIFE WITH SIDE LOCKING MECHANISM

BACKGROUND

An out-the-front knife, also known as an OTF knife, a sliding knife, or a telescoping knife is a pocketknife with a blade that opens and closes through a hole in one end of the handle. This is in contrast to folding knives or knives with fixed blades. Out-the-front knives also exist in many varieties, including manually operated in which the opening and closing of the knife is manually actuated, single action automatic knives in which the blade is opened automatically but manually retracted, and double action automatic knives in which both the opening and the closing of the knife is automatic. What is presented is an improved double action out-the-front knife that overcomes some of the deficiencies of prior art configurations

SUMMARY

What is presented is an out-the-front knife comprising a handle having a blade channel, a slider channel, and an insert channel interposed between the blade channel and the slider channel. A blade in the blade channel is configured to travel along the blade channel. When the blade is retracted, the blade is secured within the handle and is housed completely within the handle. When the blade is extended, the blade is secured within the handle and extends outwardly therefrom.

A firing mechanism in the slider channel is configured to extend the blade to an open position and retract the blade to a closed position. The blade comprises a blade insert configured to contact the firing mechanism. The blade insert is located in the insert channel and configured to travel along the insert channel. The firing mechanism comprises a slider having a front leg and a rear leg. A front slider arm extends into the insert channel such that when the blade is in the open position, the blade insert is also biased against the front slider arm. A rear slider arm extends into the insert channel such that when the blade is in the closed position, the blade insert is also biased against the rear slider arm. A blade spring connects the front slider arm to the rear slider arm. A front lock extends into the insert channel such that when the blade is in the open position, the blade insert is pressed against the front lock. A rear lock extends into the insert channel such that when the blade is in the closed position, the blade insert is pressed against the rear lock. A front lock spring biases the front lock towards the front leg and a rear lock spring biases the rear lock towards the rear leg.

When the blade is in the closed position, the blade insert is in contact with the rear slider arm and the rear lock and the blade spring applies spring pressure to pull the rear slider arm towards the front slider arm. When the blade is in the open position, the blade insert is in contact with the front slider arm and the front lock and the blade spring applies spring pressure to pull the front slider arm towards the rear slider arm.

When the blade is in the open position and the slider is moved to the closed position, the front leg contacts the front lock and causes gradual movement of the front lock and the compression of the front lock spring. When the front lock finally moves away from the blade insert, the spring tension from the blade spring on the front slider arm pulls the blade insert and the blade to the closed position.

When the blade is in the closed position and the slider is moved to the open position, the rear leg contacts the rear lock and causes gradual movement of the rear lock and the compression of the rear lock spring. When the rear lock finally moves away from the blade insert, the spring tension from the blade spring on the rear slider arm pulls the blade insert and the blade to the open position.

A button moves the slider between the open position and the closed position for activating the firing mechanism. The handle comprises a frame and a cover and the blade channel is formed within the frame and the slider channel is formed within the cover. In some embodiments, the slider channel may extend into part of the frame.

The blade insert may be mounted to the blade by one of screws, pins, rivets, bolts, nuts, glue, solder, or compression. In some embodiments, the blade insert is integral to the blade.

The front leg is curved such that contact with the front lock when the blade is in the open position caused by movement of the slider to the closed position causes gradual movement of the front lock away from said blade insert. The rear leg is curved such that contact with the rear lock when the blade is in the closed position caused by movement of the slider to the open position causes gradual movement of the rear lock away from said blade insert.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Double action out-the-front knives typically have locks that release the blade under spring pressure and lock directly onto the blade. These locks apply pressure on the blade throughout the travel of the blade as it extends or retracts. This slows down the blade and can also leave marks on the blade as the lock rubs against the blade surface. This also means that the deployment spring must be strong enough to not only spring the blade out of the handle and into the locked open position, but also to overcome the drag imparted by the lock pressing against the blade as it is being deployed. The deployment spring must also be strong enough to work in reverse to close retract the blade back into the handle and into the locked closed position and overcome the drag imparted by the lock pressing against the blade as it is being retracted.

Such prior art configurations also restrict the design of the blade because locking systems can get caught on the sharp edges of the blade. Because they are in constant contact with the blade, the lock themselves can collect dirt and debris from dirty blades that can cause the lock to become sticky and cause the knife to fail.

Figure 1:
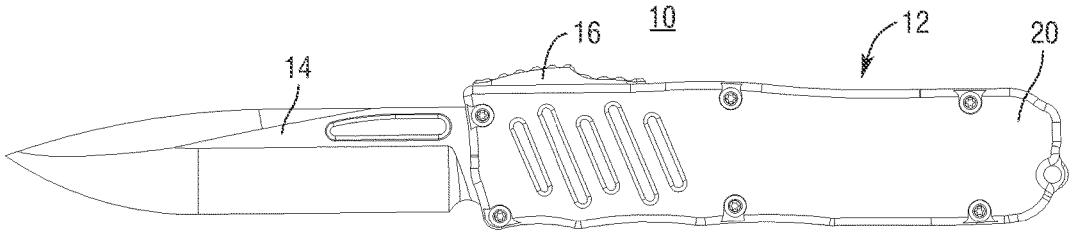
FIG. 1 is a side view of the out-the-front knife.

The out-the-front knife 10 shown in FIG. 1 addresses many of the drawbacks of the prior art. The out-the-front knife 10 comprises a handle 12 and a blade 14. A button 16 located at the top of the handle 12 actuates the operation of the out-the-front knife 10. As will be discussed herein, from the open position shown in FIG. 1, pulling backwards on the button 16 along the length available for it to travel actuates the internal mechanisms of the out-the-front knife 10 causing the blade 14 to fully retract into the handle 12 (as depicted in the cut-away view shown in FIG. 5). As will be discussed herein, from the closed position shown in FIG. 5, pushing forwards on the button 16 along the length available for it to travel actuates the internal mechanisms of the out-the-front knife 10 causing the blade 14 to fully extend out of the handle 12 (as depicted in FIG. 1 and in the cut-away view shown in FIG. 4).

Figure 2:
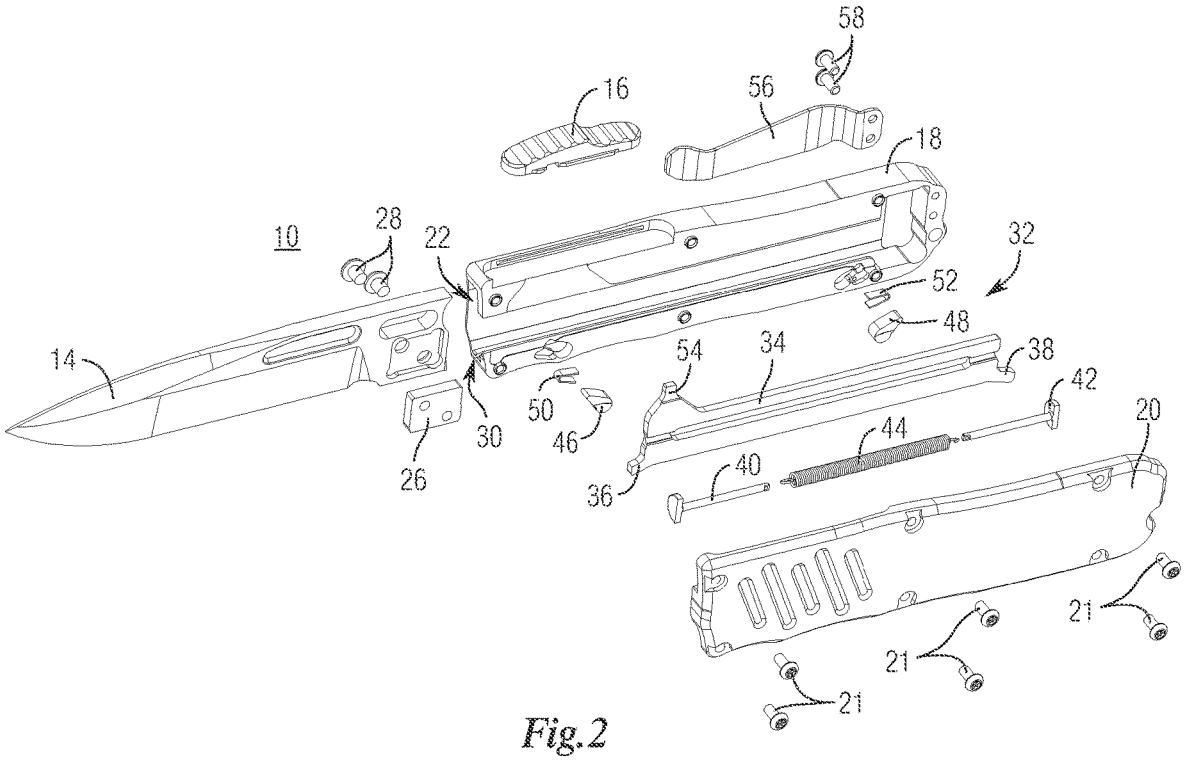
FIG. 2 is an exploded view of the out-the-front knife of FIG. 1.
Figure 3:
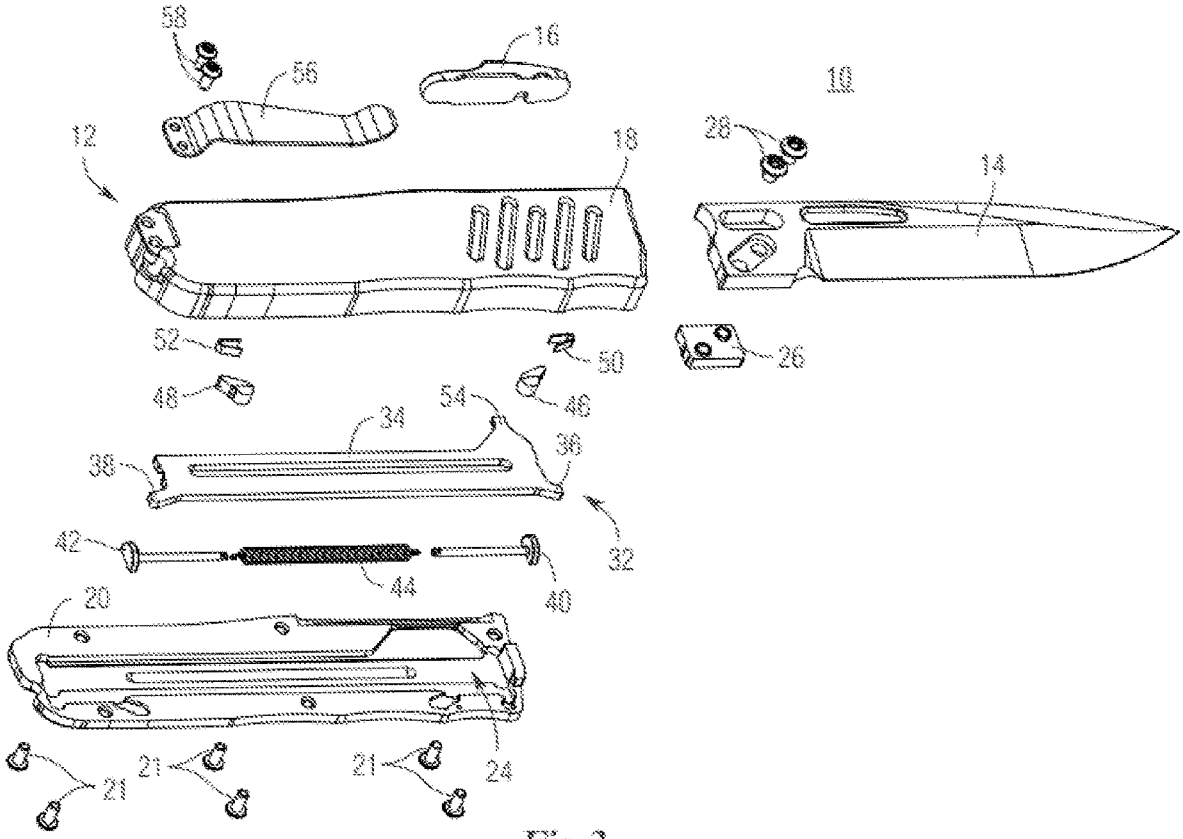
FIG. 3 is another exploded view of the out-the-front knife of FIG. 1 showing the opposite side of the knife.

As best understood by comparing FIGS. 1 through 3, the handle 12 comprises a frame 18 and a cover 20 that are secured to each other with screws 21. It will be understood that other attachment devices may be used to secure the cover 18 to the frame 20, such as pins, bolts, rivets, glue, a compression fit, etc. A blade channel 22 is formed within the frame 18 and a slider channel 24 is formed within the cover 20. In some embodiments, the slider channel 24 may extend into part of the frame 18. The blade 14 travels through the blade channel 22 when it moves into and out of the handle 12. When the blade 14 is retracted it is secured within the handle 12 and is housed completely within the handle 12 and when the blade 14 is extended it is secured within the handle 12 and extends outwardly therefrom.

A blade insert 26 is mounted to an opening in the blade 14 that is sized to receive it. In the embodiment shown, the blade insert 26 is mounted to the blade 14 with screws 28. However, it is understood that other attachment devices may be used such as pins, rivets, bolts, nuts, etc. The blade insert 26 could also be glued, soldered, or compression fit into the blade 26. While the blade insert 26 is a separate piece from the blade 14, it is possible for the blade insert 26 to be formed directly as an integral part of the blade 14.

An insert channel 30 is interposed between the blade channel 22 and the slider channel 24. The insert channel 30 is sized to fit the blade insert 26. As the blade 14 travels through the blade channel 22, the blade insert 26 travels through the insert channel 30.

Figure 4:
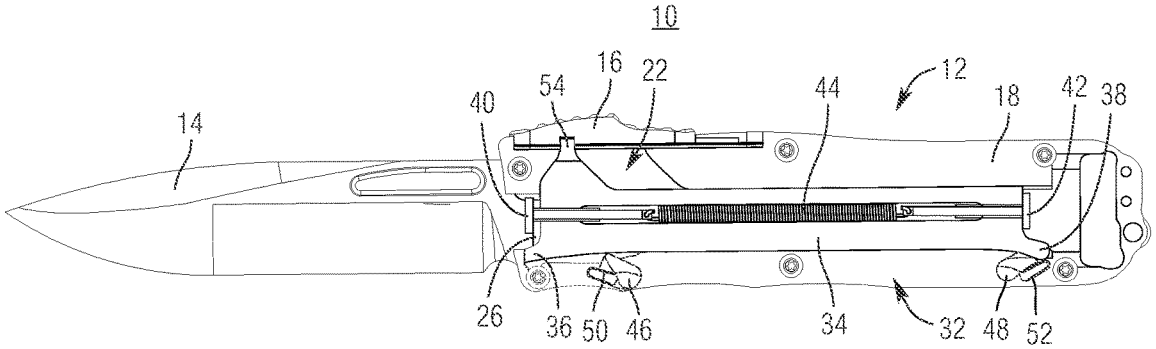
FIG. 4 is another side view of the out-the-front knife of FIG. 1 showing the inner workings of the knife in the open position.
Figure 5:
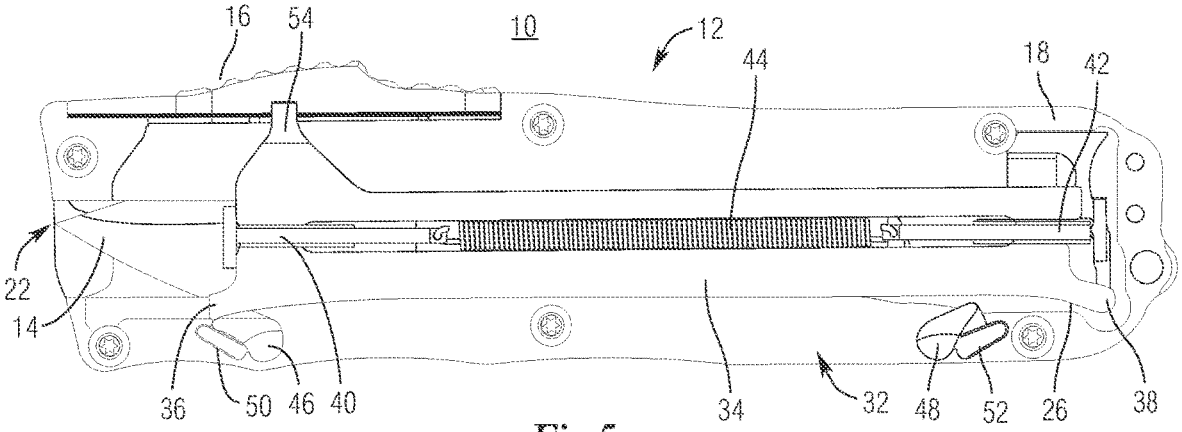
FIG. 5 is another side view of the out-the-front knife of FIG. 1 showing the inner workings of the knife in the closed position.

A firing mechanism 32 is positioned within the slider channel 24 for extending the blade 14 to an open position and retracting the blade 14 to a closed position. The firing mechanism 32 comprises a slider 34 that has a front leg 36 and a rear leg 38, a front slider arm 40, a rear slider arm 42, and a blade spring 44 that connects them together. The front slider arm 40 extends into the insert channel 30 such that when the blade 14 is in the open position, the blade insert 26 is biased against the front slider arm 40 (as can be seen in FIG. 4). The rear slider arm 42 also extends into the insert channel 30 such that when the blade 14 is in the closed position, the blade insert 26 is biased against the rear slider arm 42.

A front lock 46 located in the slider channel 24 also extends into the insert channel 30 such that when the blade 14 is in the open position, the blade insert 26 is pressed against the front lock. A rear lock 48 located in the slider channel 26 also extends into the insert channel 30 such that when the blade 14 is in the closed position, the blade insert 26 is pressed against the rear lock 48. A front lock spring 50 biases the front lock 46 towards the front leg 36 and a rear lock spring 52 biases the rear lock 48 towards the rear leg 38. The slider 34 has a nub 54 that fits into the opening in the button 16. This allows the button 16 to move the slider 34 between the open position and the closed position for activating the firing mechanism 32. In certain embodiments, an attachment clip 56 may be secured to the frame 18 of the handle 12 by screws 58 for mounting of the out-the-front knife 10.

When the blade 14 is in the closed position, the blade insert 26 is in contact with the rear slider arm 42 and the rear lock 48. The blade spring 44 applies spring pressure to pull the rear slider arm 42 towards the front slider arm 40. The rear lock 48 holding back the blade insert 26 prevents the movement of the blade 14 out of the handle 12.

When the button 16 is moved to move the slider 34 from the closed position to the open position, the rear leg 38 contacts the rear lock 48. The rear leg 38 is curved such that contact with the rear lock 48 caused by movement of the slider 34 to the open position causes gradual movement of the rear lock 48 and the compression of the rear lock spring 52. When the rear lock 48 finally moves away from the blade insert 26, the spring tension from the blade spring 44 on the rear slider arm 42 pulls the blade insert 26 and the blade 14 towards the open position with sufficient force to extend the blade 14 fully to the open position and contact the blade insert 26 with the front lock 46 and the front slider arm 40.

When the blade 14 is in the open position, the blade insert 26 is in contact with the front slider arm 40 and the front lock 46. The blade spring 44 applies spring pressure to pull the front slider arm 40 towards the rear slider arm 42. The front lock 46 holding back the blade insert 26 prevents the movement of the blade 14 back into the handle 12.

When the button 16 is moved to move the slider 34 from the open position to the closed position, the front leg 36 contacts the front lock 46. The front leg 36 is curved such that contact with the front lock 46 caused by movement of the slider 34 to the closed position causes gradual movement of the front lock 46 and the compression of the front lock spring 50. When the front lock 46 finally moves away from the blade insert 26, the spring tension from the blade spring 44 on the front slider arm 40 pulls the blade insert 26 and the blade 14 towards the closed position with sufficient force to retract the blade 14 fully to the closed position and contact the blade insert 26 with the rear lock 48 and the rear slider arm 42.

The arc of the curves on the front leg 36 and the rear leg 38 can be varied to adjust the difficulty of activating the firing mechanism 32.

Unlike with prior art configurations, with the out-the-front knives 10 disclosed herein, the front lock 46 and the rear lock 48 do not lock into the blade 14 but rather to the blade insert 26. This means that the front lock 46 and the rear lock 48 are free floating during the deployment and retraction of the blade 14 and do not slow down the blade 14 as it moves through the blade channel 22. This further means that, unlike with prior art knives, there is no internal mechanism of the out-the-front knife 10 that can get caught up on the blade 14 itself. Because the blade 14 itself never comes in contact with the front lock 46 and the rear lock 48, debris and dirt on the blade 14 is less likely to affect the front lock 46 and the rear lock 48 and less likely to cause failure at those locations.

Not having drag being imparted on the blade 14 by the front lock 46 and the rear lock 48, means that a weaker blade spring 44 may be used to operate the out-the-front knife 10.

This makes the button 16 function much easier to operate so a wider range of people are able to operate the out-the-front knife 10. Using a weaker blade spring 44 also means that the internal parts of the out-the-front knife 10 experience less wear and extends the life of the out-the-front knife 10 overall.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. An out-the-front knife comprising:

a handle having a blade channel, a slider channel, and an insert channel interposed between said blade channel and said slider channel;

a blade in said blade channel, said blade configured to travel along said blade channel wherein when said blade is retracted, said blade is secured within said handle and is housed completely within said handle and when said blade is extended, said blade is secured within said handle and extends outwardly therefrom;

a firing mechanism in said slider channel configured to extend said blade to an open position and retract said blade to a closed position;

said blade comprising a blade insert configured to contact said firing mechanism, said blade insert located in said insert channel and configured to travel along said insert channel; and said firing mechanism comprising:

a slider having a front leg and a rear leg, a front slider arm that extends into said insert channel such that when said blade is in said open position, said blade insert is also biased against said front slider arm;

a rear slider arm that extends into said insert channel such that when said blade is in said closed position, said blade insert is also biased against said rear slider arm;

a blade spring that includes two opposing ends having one end connected to said front slider arm and the other end connected to said rear slider arm;

a front lock that extends into said insert channel such that when said blade is in said open position, said blade insert is pressed against said front lock; and a rear lock that extends into said insert channel such that when said blade is in said closed position, said blade insert is pressed against said rear lock.

2. The out-the-front knife of claim 1 further comprising:

a front lock spring that biases said front lock towards said front leg; and a rear lock spring that biases said rear lock towards said rear leg.

3. The out-the-front knife of claim 1 wherein:

when said blade is in said closed position, said blade insert is in contact with said rear slider arm and said rear lock, and said blade spring applies spring pressure to pull said rear slider arm towards said front slider arm; and when said blade is in said open position, said blade insert is in contact with said front slider arm and said front lock, and said blade spring applies spring pressure to pull said front slider arm towards said rear slider arm.

4. The out-the-front knife of claim 1 further comprising:

a front lock spring that biases said front lock towards said front leg;

a rear lock spring that biases said rear lock towards said rear leg;

when said blade is in said open position and said slider is moved to said closed position, said front leg contacts said front lock, causes gradual movement of said front lock and the compression of said front lock spring, and when said front lock finally moves away from said blade insert, the spring tension from said blade spring on said front slider arm pulls said blade insert and said blade to said closed position; and when said blade is in said closed position and said slider is moved to said open position, said rear leg contacts said rear lock, causes gradual movement of said rear lock and the compression of said rear lock spring, and when said rear lock finally moves away from said blade insert, the spring tension from said blade spring on said rear slider arm pulls said blade insert and said blade to said open position.

5. The out-the-front knife of claim 1 further comprising a button for moving said slider between said open position and said closed position for activating said firing mechanism.

6. The out-the-front knife of claim 1 wherein said handle comprises a frame and a cover.

7. The out-the-front knife of claim 1 wherein said handle comprises a frame and a cover, and said blade channel is formed within said frame and said slider channel is formed within said cover.

8. The out-the-front knife of claim 1 wherein said blade insert is mounted to said blade by one of screws, pins, rivets, bolts, nuts, glue, solder, or compression.

9. The out-the-front knife of claim 1 wherein said blade insert is integral to said blade.

10. The out-the-front knife of claim 1 wherein:

said front leg is curved such that contact with said front lock when said blade is in said open position caused by movement of said slider to said closed position causes gradual movement of said front lock away from said blade insert; and said rear leg is curved such that contact with said rear lock when said blade is in said closed position caused by movement of said slider to said open position causes gradual movement of said rear lock away from said blade insert.

11. An out-the-front knife comprising:

a handle having a blade channel, a slider channel, and an insert channel interposed between said blade channel and said slider channel;

a blade in said blade channel, said blade configured to travel along said blade channel wherein when said blade is retracted, said blade is secured within said handle and is housed completely within said handle and when said blade is extended, said blade is secured within said handle and extends outwardly therefrom;

a firing mechanism in said slider channel configured to extend said blade to an open position and retract said blade to a closed position;

said blade comprising a blade insert configured to contact said firing mechanism, said blade insert located in said insert channel and configured to travel along said insert channel; and said firing mechanism comprising:

a slider having a front leg and a rear leg, a front slider arm that extends into said insert channel such that when said blade is in said open position, said blade insert is also biased against said front slider arm;

a rear slider arm that extends into said insert channel such that when said blade is in said closed position, said blade insert is also biased against said rear slider arm; and a blade spring that includes two opposing ends having one end connected to said front slider arm and the other end connected to said rear slider arm.

12. The out-the-front knife of claim 11 further comprising:

a front lock that extends into said insert channel such that when said blade is in said open position, said blade insert is pressed against said front lock; and a rear lock that extends into said insert channel such that when said blade is in said closed position, said blade insert is pressed against said rear lock.

13. The out-the-front knife of claim 12 further comprising:

a front lock spring that biases said front lock towards said front leg; and a rear lock spring that biases said rear lock towards said rear leg.

14. The out-the-front knife of claim 12 wherein:

when said blade is in said closed position, said blade insert is in contact with said rear slider arm and said rear lock, and said blade spring applies spring pressure to pull said rear slider arm towards said front slider arm; and when said blade is in said open position, said blade insert is in contact with said front slider arm and said front lock, and said blade spring applies spring pressure to pull said front slider arm towards said rear slider arm.

15. The out-the-front knife of claim 12 further comprising:

a front lock spring that biases said front lock towards said front leg;

a rear lock spring that biases said rear lock towards said rear leg;

when said blade is in said open position and said slider is moved to said closed position, said front leg contacts said front lock, causes gradual movement of said front lock and the compression of said front lock spring, and when said front lock finally moves away from said blade insert, the spring tension from said blade spring on said front slider arm pulls said blade insert and said blade to said closed position; and when said blade is in said closed position and said slider is moved to said open position, said rear leg contacts said rear lock, causes gradual movement of said rear lock and the compression of said rear lock spring, and when said rear lock finally moves away from said blade insert, the spring tension from said blade spring on said rear slider arm pulls said blade insert and said blade to said open position.

16. The out-the-front knife of claim 12 further comprising:

said front leg is curved such that contact with said front lock when said blade is in said open position caused by movement of said slider to said closed position causes gradual movement of said front lock away from said blade insert; and said rear leg is curved such that contact with said rear lock when said blade is in said closed position caused by movement of said slider to said open position causes gradual movement of said rear lock away from said blade insert.

17. The out-the-front knife of claim 11 further comprising a button for moving said slider between said open position and said closed position for activating said firing mechanism.

18. The out-the-front knife of claim 11 wherein said handle comprises a frame and a cover.

19. The out-the-front knife of claim 11 wherein said handle comprises a frame and a cover, and said blade channel is formed within said frame and said slider channel is formed within said cover.

20. The out-the-front knife of claim 11 wherein said blade insert is mounted to said blade by one of screws, pins, rivets, bolts, nuts, glue, solder, or compression.

21. The out-the-front knife of claim 11 wherein said blade insert is integral to said blade.

* * * * *